United States Patent [19]

Levine

[11] 4,293,968

[45] Oct. 13, 1981

[54] INTERCONNECTED WATER SKIS

[76] Inventor: Elliott M. Levine, 393 Kingston Crescent, Winnipeg, Manitoba, Canada

[21] Appl. No.: 958,157

[22] Filed: Nov. 6, 1978

[30] Foreign Application Priority Data

Nov. 11, 1977 [GB] United Kingdom ..... 47063/77

[51] Int. Cl.[3] ..... A63C 5/00; A63C 9/00; A63C 11/00; A63C 15/00

[52] U.S. Cl. ..... 9/310 A; 9/310 D; 9/310 R; 9/310 B

[58] Field of Search ..... 9/310 R, 310 A, 310 AA, 9/310 C, 310 D, 310 F; 114/61; 115/26, 26.1, 22, 22.1; 280/11.37 E; 440/22, 21

[56] References Cited

U.S. PATENT DOCUMENTS

| | | | |
|---|---|---|---|
| 2,828,491 | 4/1958 | Turgeon | 9/310 R |
| 2,938,220 | 5/1960 | Puckett | 9/310 R |
| 2,959,795 | 11/1960 | Leung | 9/310 C |
| 3,020,568 | 2/1962 | Tierney | 9/310 A |
| 3,040,345 | 6/1962 | Green | 9/310 A |
| 3,103,673 | 4/1963 | Martin | 9/310 A |
| 3,357,714 | 12/1967 | Kuehn | 280/11.37 E |
| 3,422,786 | 1/1969 | Brandhorst | 9/310 C |
| 3,751,056 | 8/1973 | Wightman | 280/11.37 E |
| 3,936,897 | 2/1976 | Schaumann | 9/310 D |
| 4,034,430 | 7/1977 | Joyce | 9/310 D |

*Primary Examiner*—Trygve M. Blix
*Assistant Examiner*—D. W. Keen
*Attorney, Agent, or Firm*—Stanley G. Ade

[57] ABSTRACT

Application of at least one slot notch or groove to or near the rear of a single or pair of towed planing boards or surfaces. Such slots or the like induce a water geyser at speed that improves the appearance and/or directional control of such boards. Such slots or the like are especially effective and practical for deep displacement type boards whose zero and low speed efficiency and stability is especially improved for paired boards or ski when such are fitted with a rigid or preferably semi-rigid connector as hereinafter described. The addition of slots or the like, and where applicable suitable connectors, to generally improve combination displacement-planing boards by: economically providing an aesthetically pleasing water spout induced at speed for planing boards, economically providing a novel and improved apparatus for establishing directional control and stability, improving the lateral stability of ski sets especially at zero and low velocities, practically reducing the bulk or required net displacement of ski sets especially at zero and low velocities and more simply providing a foot restraint.

6 Claims, 55 Drawing Figures

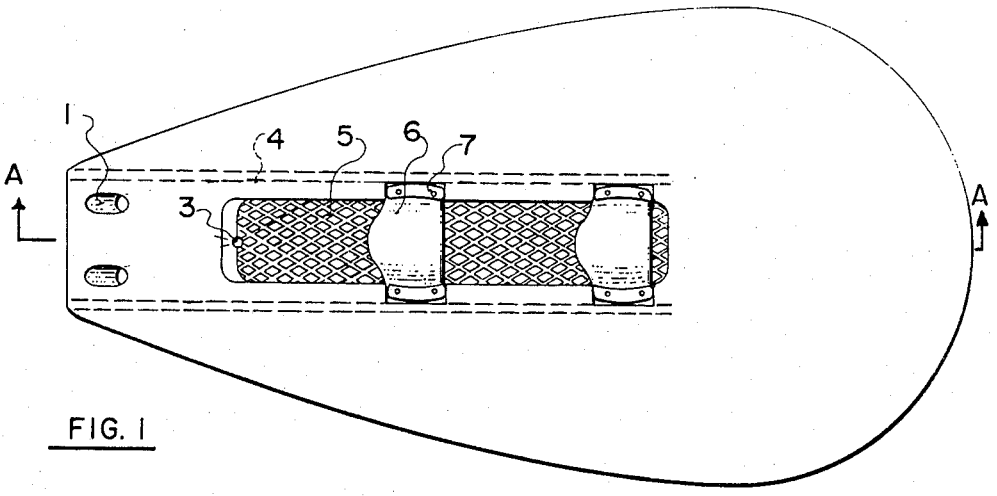
FIG. 1
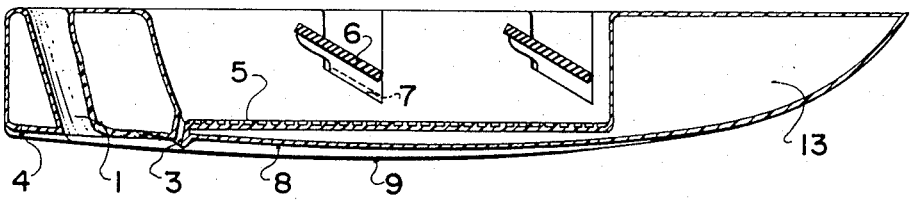
FIG. 2 (A-A)
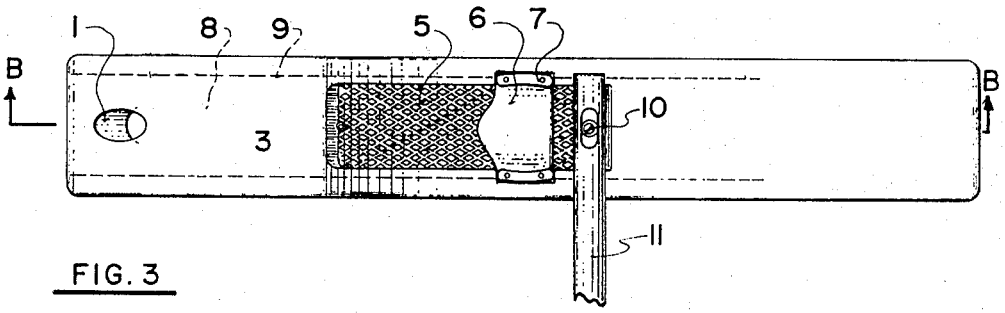
FIG. 3

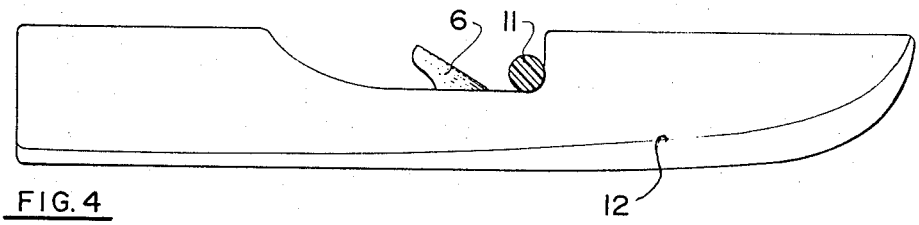
FIG. 4
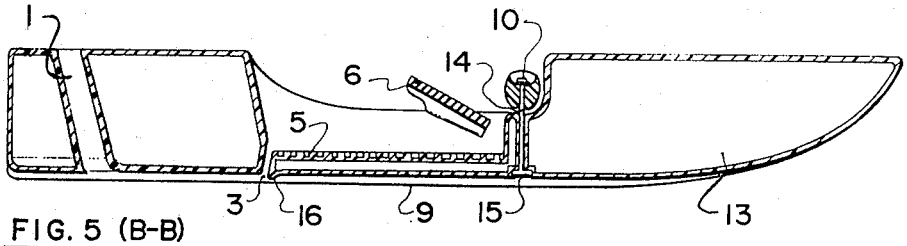
FIG. 5 (B-B)
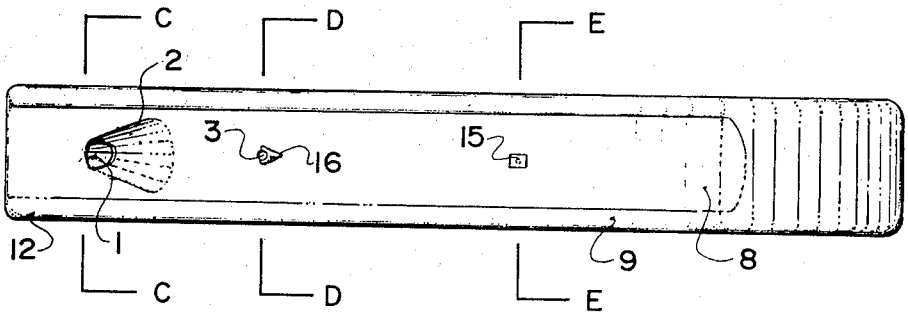
FIG. 7
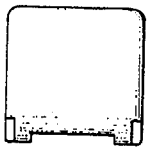
FIG.8
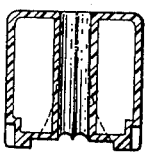
FIG.7 C-C
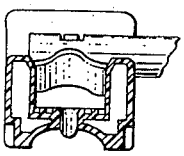
FIG.7 D-D
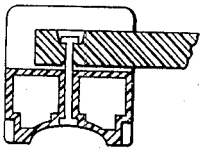
FIG.7 E-E

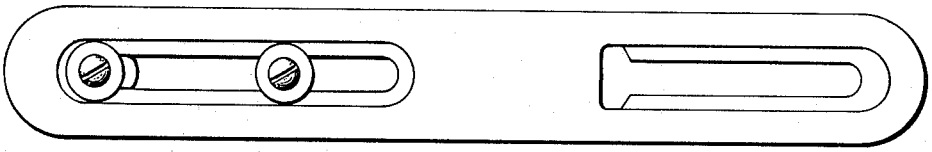
FIG. 14
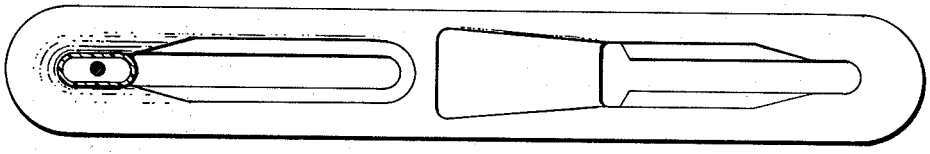
FIG. 15
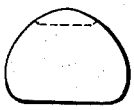
FIG. 16
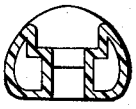
FIG. 17
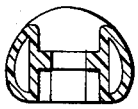
FIG. 18
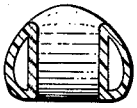
FIG. 19
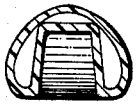
FIG. 20
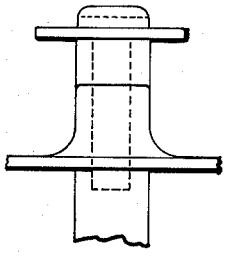
FIG. 21
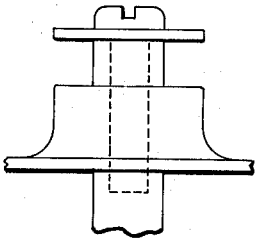
FIG. 22
FIG. 25
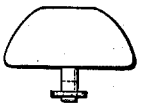
FIG. 26
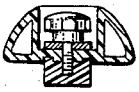
FIG. 23
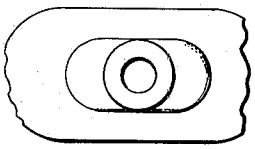

INTERCONNECTED WATER SKIS

BACKGROUND OF THE INVENTION

Planing water skis typically attain improved directional control by addition of a keel or rudder that optimally can also induce a geyser or rooster tail of water.

Buoyant pairs of displacement water skis typically sustain the full weight of the skier on each ski and have excess displacement and length for stability. Known connectors for such skis are hinged or flexible and suited to walking or conventional gliding snow skiing motions and either inhibit planing and/or prevent desirable relative tip motion (i.e. pitching) and are flexible such that significant displacement reduction of the ski set, that I have found possible with rigid and semi-rigid connectors, is not possible (U.S. Pat. No.: 3,121,892).

SUMMARY OF THE INVENTION

Slots, notches or deep grooves placed at or near the stern or rear of water planing boards or surfaces will induce an attractive water spout. If we consider the slotted situation we find that a slight drag occurs due to increased wetted surface but more critically due to the rear surface of the slot acting as a scoop. Differential loading of a pair of slot equipped skis will thus cause a significant drag that enhances turning. Further, the general action of the water spout is such that directional stability is enchanced. At significant relative velocity the underside of the ski develops a high pressure resistance relative to the water. Any hole or slot in the ski under surface thus represents a low pressure region through which the water will rush to relieve the pressure differential providing the slot is suitably angled and, most critically, is provided with a concave or at least a flush entry lip. While I have found an almost vertical hole flush with the under surface to function well, it is obvious that variations are possible. Illustrated are preferred embodiments showing the hole sloped to the rear with the mouth broader and slightly elevated at the front and depressed at the rear with the sides tending to trap and direct the high pressure flow towards the slot.

The existence of this vertical flow establishes a force that tends to resist sideways motion. As well the pressure on the rear of the slot, due to its location, can act as a beneficial drag on the system. The rear surfaces of the slot may thus be seen to act as a scoop that induces a dramatic water spout or geyser that is significant even at minimal planing speeds. Stern notches or grooves will obviously effect some of the above results, at a very high speeds such reduced effect may become preferable.

Such slots or the like are especially useful and practical where deep ski sections are considered. Optimally deep sections have sufficient displacement to stably support a skier at zero relative velocity. Application to, and residual improvement in, surf boards and the like is thus included in this specification.

Where such displacement skis individually have sufficient width, or are rigidly or semi-rigidly connected in paired sets so as to establish a stable platform of sufficient width, then a satisfactory buoyant ski unsuited to water walking, independent ski movement and the like, but suited for towing and/or planing motion, typically shorter and of less than one-half the displacement of conventional buoyant independent, hinged, or flexibly connected, skis is possible. (U.S. Pat. No.: 3,134,114; 2,716,246; 3,115,860 and 3,742,886). Such rigid or semi-rigid platform is readily and stably mountable from the water and capable of successively starting and stopping a skier without the skier becoming immersed. As such a platform shifts from a displacement to a planing platform with the skier totally above the water, the conventional unstable, skill requiring, and power consuming, starting stage is eliminated. Experience has shown that individual skis of a connected set are suitable for carrying a skier weighing up to 50% greater than the single ski net displacement, and with lengths of 80% of skier height satisfactory, with even shorter lengths possible. Thus, for a suitably connected pair, or for a single wide ski, a total net displacement of as little as 33% above skier weight provides a satisfactory stable platform. A further benefit of such a platform is the comfort and simplicity made possible for the foot harness, a simplified front restraint with the rear portion eliminated has been found to be eminently satisfactory for such a combination displacement planing platform.

It is thus, obvious as explained above, that the optimal slotted water ski will be a combination displacement-planing board/platform with sufficient width and rigidity to attain satisfactory stability at greatly reduced bulk compared to typical displacement skis, and of sufficient depth to optimally and readily realize the advantages of the slot or the like. However the slot or slots can be dispensed with if desired.

Given the depth, sufficient flotation/net displacement should be realized so as to stably support the intended skier at zero velocity, likewise given such flotation, suitable ski width or connectors for paired skis become highly desirable.

It will be apparent that the optimal connector for establishing the platform will either be substantially rigid or allowing of a limited rolling motion about the longitudinal ski axis, will be substantially rigid in establishing the platform width, and will allow substantial motion about the axis of the connector so as to allow ready independent over-riding of waves and slot benefit as described above. Thus a single simply pinned connector of relatively symmetrical section is optimal, such connector section readily responding to torsion forces so as to twist. I have found a 2" outside diameter polyvinyl chloride round section to be suitable and that slight asymmetry, (by addition of grooves or the like), can optionally improve controlled bending (this is especially useful where a rigid connection is employed). However other materials can of course be utilized.

Given the above consideration, the connector must be situated clear above the water in planing configuration and this is readily attainable for deep displacement skis. It must optimally be situated ahead of the rear so as to be clear of the water and to allow for the above described twist/drag, and is preferably behind the front so as to readily flex at the tip so as to allow pitching independent over-riding of waves/wake, and for control as described above. Hence an approximate mid-portion mounting is preferable, if not mandatory, with a mounting point above and immediately ahead of the foot well being satisfactory.

Further refinements are the incorporation of an automatic bailing hole moulded into the footwell and concave indentation(s) for the planing under surface. An integral splash rail to reduce the wetted surface and hardware holes, etc., to reduce labour and improve quality control may also be included.

The above invention may be variously constructed but is admirably suited to economical execution in a hollow moulded vinyl or other suitable synthetic plastic material optionally and preferably filled with a rigid cellular foam. The slot and hardware openings can be moulded into the basic ski hull and the connection, where applicable, can simply be provided by a plastic tube fitted with two non-rusting bolts as described below.

With the foregoing in view, and other advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

FIG. 1 is a single wide ski, top view.

FIG. 2 is a section A—A, side view, as per FIG. 1.

FIG. 3 is a top view showing one of one embodiment of a connected ski pair.

FIG. 4 is a side view of FIG. 3.

FIG. 5 is a section B—B, side view, as per FIGS. 3 and 4.

FIG. 7 is a bottom view showing one of a connected pair.

FIG. 7 (C—C), 7 (D—D) and 7 (E—E), are sections of FIG. 7.

FIG. 8 is an end view of FIG. 7.

FIG. 14 shows a top plan view of the main connector bar with the lefthand side showing a connector post restraining fitting and a typical closed slot (also shown in FIG. 13).

FIG. 15 shows an underside view of the main connector bar with the lefthand connector point indicated and the righthand slot modified for disconnection as also shown in FIGS. 13 and 14.

FIG. 16 shows an end view of the main connector bar.

FIG. 17 shows an end or parallel constraining condition section along the line 17—17 of FIG. 12.

FIG. 18 shows a rotating or variable beam and waterline connection shown in section along the line 18—18 of FIG. 12.

FIG. 19 shows the uncovered opening available when the optional restraining hardware is removed so as to allow the connector point/post to slide clear of the main connector bar. This is a sectional along the line 19—19 of FIG. 12.

FIG. 20 is a cross sectional view similar to FIG. 19 along the line 20—20 of FIG. 12 but showing the covering overhead which acts to readily guide the connector post to a smooth disconnect.

FIG. 21 shows an end view of a typical connector post with hardware in place.

FIG. 22 is a similar view of this post but showing a front elevation.

FIG. 23 is a top plan view of this post but with the hardware removed.

FIG. 25 is an end elevation of FIG. 24.

FIG. 26 is a section along the line 26—26 of FIG. 24.

In the drawings like characters of reference indicate corresponding parts in the different figures.

DETAILED DESCRIPTION

Figure 6:
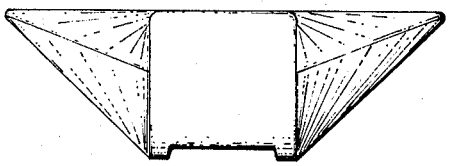
FIG. 6 is a rear view of single wide ski.
Figure 10:
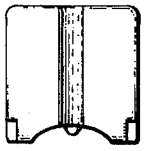
FIG. 10 is an end view of one of a connected pair of skis with optional groove.
Figure 11:
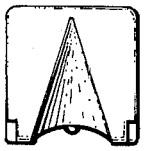
FIG. 11 is an end view of one of a connected pair of skis with optional notch.
Figure 9:
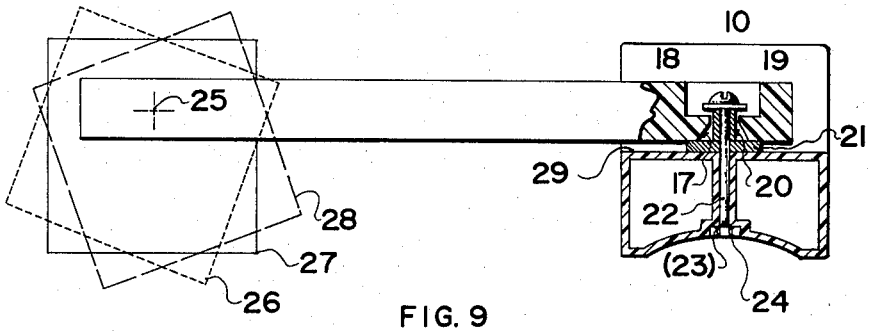
FIG. 9 is a connector detail, showing controlled roll and hardware.
Figure 12:
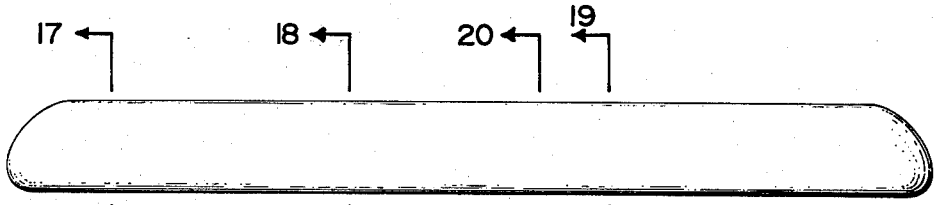
FIG. 12 shows a front/rear view of a main connector bar, with variable geometry capacity.

It is to be understood that these represent typical but not exclusive embodiments of the invention.

1 is a slot with a wide mouth 2. 3 is a drain hole for a footwell with non-slip surface 5. 6 is a foot restraint fitted to moulded position including screw holes 7. 8 is a concave under surface with sides 4 or 9. 10 is a symmetrically located connector bolthead fitted to slot 14 and moulded nut retainer 15. 13 is a cellular rigid foam. 12 is a splash rail. 16 is a convex shape establishing vacuum for drain 3 at planing speed. 17 is an enlarged slot and 18 is a countersunk bolt receptable for a connector tube 11. 19 and 21 are washers that sandwich a spacer 20. Bolt shaft 22 fits a nut 24 with an optional small washer and locker washer located at 23. 25 is a symmetrical point of connector loading and substantially the pivot point for controlled ski roll schematically shown at midpoint 27, to one side 26, and to the other side 28. The connector may of course be located horizontally at 25, in which case it is restrained by shelf 29.

Proceeding next to describe the variable geometry/-controlled motion connectors for combination displacement planing and other buoyant water skis as a species of rigid or semirigid connectors for same, reference should be made to FIGS. 12 through 46.

This part of the invention refers to an improved connector for water skis of the displacement type; it is a species of semi-rigid connector that incorporates specifically a capacity to allow additional relative controlled motion of the skis so that a variety of desirable configurations may readily be attained either at the discretion of the skier, or automatically.

Some of these motions or configurations are:

(1) A stable maximum beam situation with the skis restrained in a relatively parallel fashion, that is with the connector substantially at right angles to the principal axis of the skis.

(2) A means to allow variation in the beam of the connected ski pair so that manoeuverability may be enhanced at planing speed when the maximum beam desired for low speed stability is no longer required.

(3) A means to allow the waterline of the connected ski set to be increased, and to allow skier weight to be more readily shifted fore and aft, said conditions providing a less choppy and smoother ride that is also more easy to control given the fore and aft stance available to the skier's feet.

(4) A means to provide for a limited or restricted roll of the skis relative to each other.

(5) A means to allow for the relatively free but controlled pitching of the skis relative to each other so as to facilitate independent response to wave action and to allow for optimal steering control while at the same time preventing unrestrained pitching motion so as to facilitate mounting. of the skis from the water.

(6) Means to control or restrain the relative roll of the skis so as to facilitate manoeuverability while preventing an unrestrained roll whereby mounting of the ski set is facilitated. These last named restraints allow for best minimizing the displacement of the ski set by allowing them to act substantially as a single somewhat flexible platform to share in carrying the skier load. Practical, but not exclusive, means for realizing the above requirements is illustrated and described.

(7) A means to disconnect a pair of otherwise rigidly or seemingly connected skis so as to allow for planing or single "slalom" ski operation.

(8) A means to realize the various combination of connector features with a single connector bar, said bar being fitted with restraints so as to limit or allow the connector motion as follows:

(a) to a parallel configuration
(b) a parallel configuration of fixed beams
(c) to a varible beam and
(d) a variable waterline configuration
(e) a disconnect to occur It is understood that one or a combination of the above features may be coincidentially realized by such restraining devices.

Except for the last requirement, all the above requirements may be reasonably satisfied by providing the ski connector with either a single pair of elongated slots, of constant section at region of the midpoint 30 where it is narrowest, and above 31 where it is broader, but of varying section below where it is narrow 32 at the outside and flared wide towards the center 33. The slotted connector is itself a form of torsion connection tube made of suitable material, typically plastic as ABS, PVC, or high density polyethylene. The connector may freely and readily be connected to each ski by means of a bolt 34 or the like being secured from above and travelling through the slot so as to be fixed to the body of the ski, a washer may be used to improve bearing contact between the ski and the connector.

It will be useful to provide the ski with a mounting point for the connector such that said point can accommodate the connector mounting bolt and be elongated so as to restrain motion from the parallel when beam maximum is desired. Preferably the mounting point will be towards midships and to one side and on the top portion of the skis; this best facilitates movement of the skis and minimizes the required connector length, a connector bar of just under double the ski width being most suitable. Where the ski post has been formed with a neck that can readily fit through the mid-portion of the slot so as to allow for a sliding motion then additionally a lock washer may prove to be useful.

A slotted connector as above described may further be modified by altering one of the ski slots so that it opens to allow one of the connector points to come free of the main connector bar, obviously many various configurations or devices could be fashioned to perform this task. This invention describes simple and adequate means for realizing this task for rigid or semi-rigid ski connectors as applied to combination displacement-planing water skis. Under the disconnect condition it becomes desirable to either place the connector point-/post to the rear so as to clear the skier's body upon disconnection or to provide a recessed connection. Further, it becomes desirable to mould a second foot-well into one of the skis, preferably this second or rear foot restraint will be slightly elevated and sloped down to the front relative to the first or front foot-well. Further, one or a series of recessed connector points may be provided so as to allow user discretion in placing of the connector bar, thus both left and righthand kick-off skis can readily be chosen including the preferable midpoint connected ski variant when this is desired.

An alternate realization utilizing a tracked recess, of which several variations will be obvious to those skilled in the art, is available where a flush hull mount is desired. Here the principal connector 34 (see FIGS. 24 to 31) incorporates an elongated slot or slots that are fitted with a pair of slidable restraints preferably fitted with quick release ratchet, thumbscrew or wing bolt control, same being fitted to an enlarged rigid nut protruding below the connector track so as to provide controlled restraint. Such principal connector being also fitted below and at the ends 35 with an elongated post 36 and below this a round extension 37 that is threaded and fitted with a washer secured by a small screw 34', said washer securing the connector to the recessed track with the post providing variable restraint by engaging the sides of the recess. The principal connector end fitting goes into a recess moulded into the ski hull, said recess being wide or open and untracked towards the ski center so as to facilitate release and engagement of the above mentioned washer. Where connector release is not desired this feature may be omitted. The recess then becomes narrower by reason of a track or plate fitted to it, such tracks secure the connector to the ski, by reason of the flanges formed by the washer fitted to the bottom of the connector, while allowing for rotation of the connector in the plane of the deck of the ski hull at the mid-section of the recess. At the end of the recess nearest the ski edge the slot narrows so as to receive the elongated end of the connector post, in this position the connector is restrained substantially at a right angle to the ski as compared to midpoint rotation and end of track release where desired. The slots may simply be fitted with simple bolts, washers and wings nuts that may be either secured at a beneficial location along the slot, so as to control its useful length (thereby actuating the variety of configurations desired), or removed altogether as desired ski use indicates. 38 is the slidable connector restraint, with knurled nut fitted to a rust resistant knob fitted with threaded shaft. 39 is a washer for knurled nut, to bear upon principal connector track and 40 is a bolt shaft fitting of corrosion proof material and preferably squared to prevent rotation about connector slot and optionally fitted with ridges so as to prevent connector slot separation by engaging underside ridges of same.

Obviously selection of only some of the above features could still provide a connector of practical merit. It should be equally obvious that several variations of the above that are within its spirit are possible, as will be obvious to those skilled in the art, and such are included within this specification.

Figure 13:
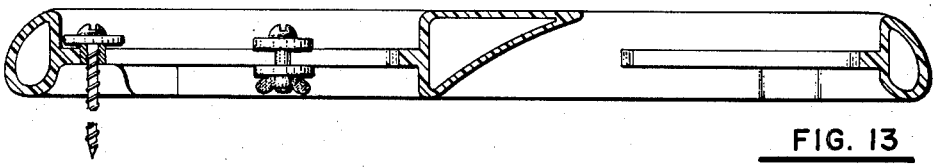
FIG. 13 shows a longitudinal section of FIG. 12.
Figure 24:
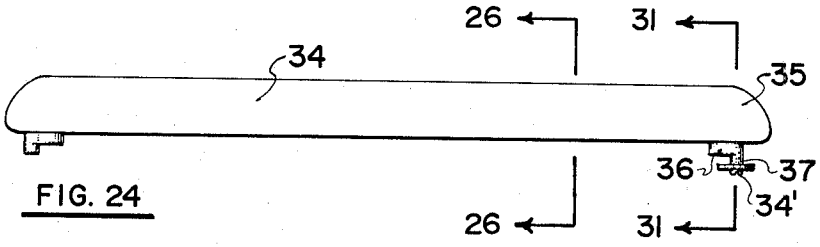
FIG. 24 is a front elevation of a simplified main slotted connector with variable geometry capacity. Alternate embodiments will be obvious to those skilled in the art.
Figure 29:
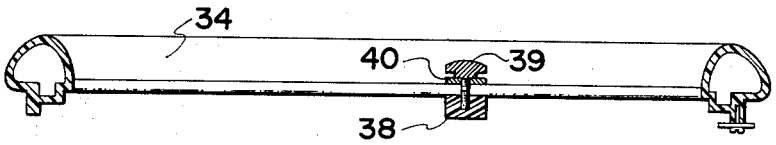
FIG. 29 is a longitudinal section along the line 29—29 of FIG. 28.
Figure 28:
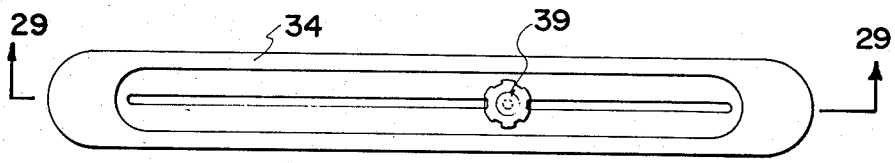
FIG. 28 is a top plan view of FIG. 24.
Figure 27:
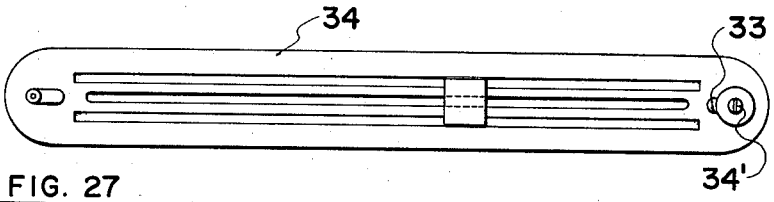
FIG. 27 is an underside view of FIG. 24.
Figure 35:
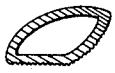
FIG. 35 is an end elevation of a curved connector plate for the foot restraint.
Figure 37:
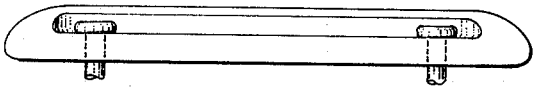
FIG. 37 is a front elevation of the plate.
Figure 36:
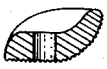
FIG. 36 is a cross sectional view of the foot restraint connector plate. The underside surface may be smooth or textured.
Figure 38:
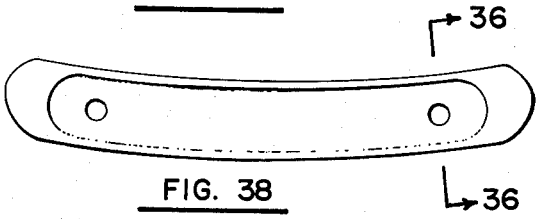
FIG. 38 is a top view of the plate. This embodiment shows two holes, a curve in the plan of the plate and a recess suited to easy mounting of the screws and economy of material which while useful, are not exclusive embodiments of this device.
Figure 30:
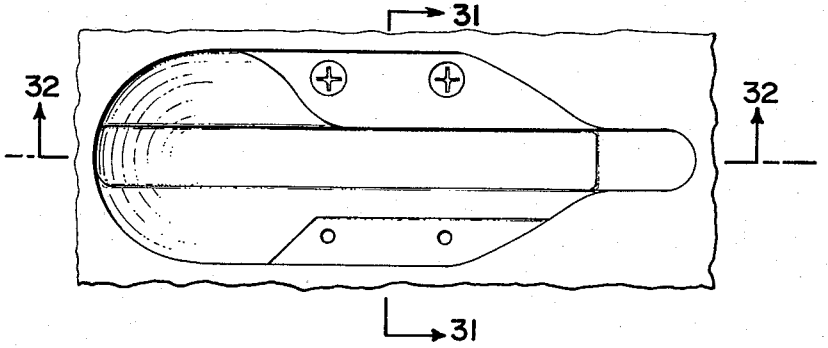
FIG. 30 is a top plan view of the receptacle with the track installed.
Figure 31:
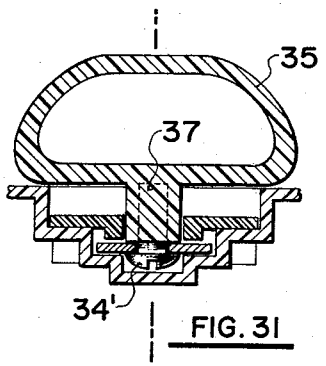
FIG. 31 is a section along the line 31—31 of FIG. 30.
Figure 32:
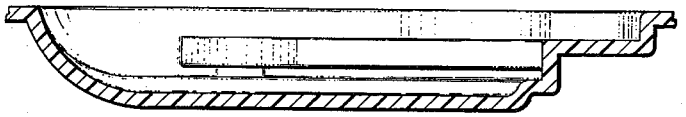
FIG. 32 is a longitudinal section along the line 32—32 of FIG. 30.
Figure 33:
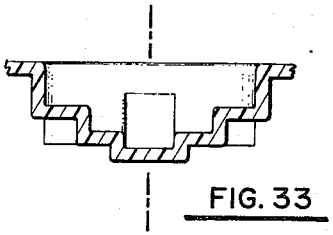
FIG. 33 is a view similar to FIG. 31 but taken as a section along the line 33—33 of FIG. 30.
Figure 34:
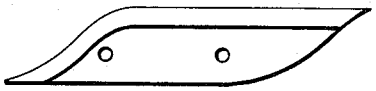
FIG. 34 is an underside view of part of the track.
Figure 39:
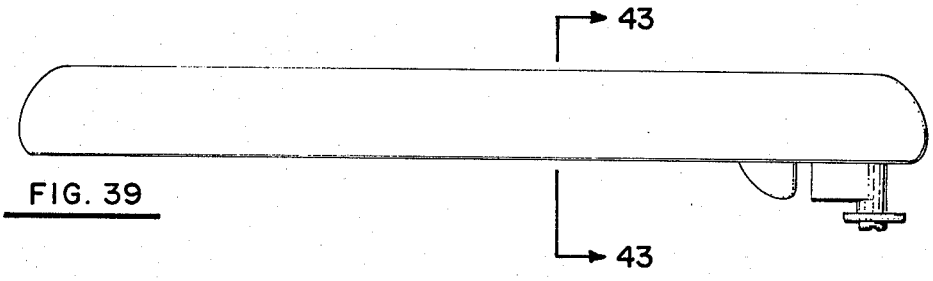
FIG. 39 is a front view of an embodiment of the connector showing a "flush deck" connector post in the righthand side thereof which for safety reasons makes it a preferred embodiment of the illustrative series of variable geometry connectors herein described.
Figure 40:
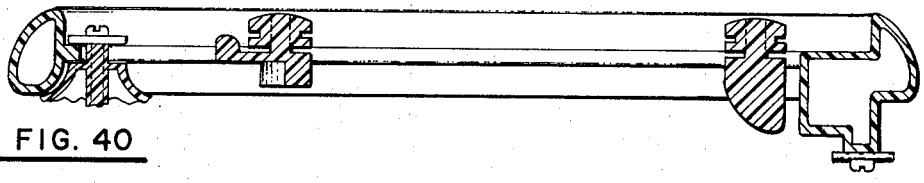
FIG. 40 is a longitudinal section along the line 40—40 of FIG. 41 showing a simple track and examples of different end connector point conditions and variable restraints.
Figure 41:
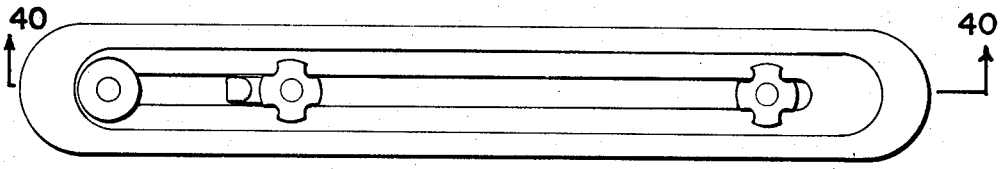
FIG. 41 is a top plan view of the main connector of FIG. 39 showing lefthand connector post as in FIGS. 21 to 23, with adjustable restraints, shown as knurled nuts, in place.
Figure 42:
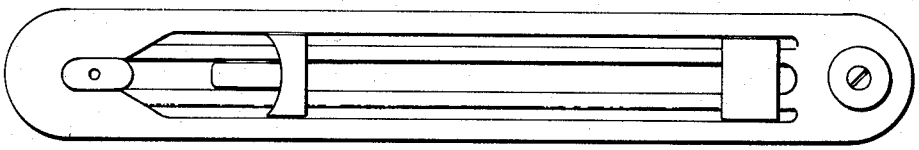
FIG. 42 is an underside view of the connector with variation in slots to accommodate connector posts.
Figure 43:
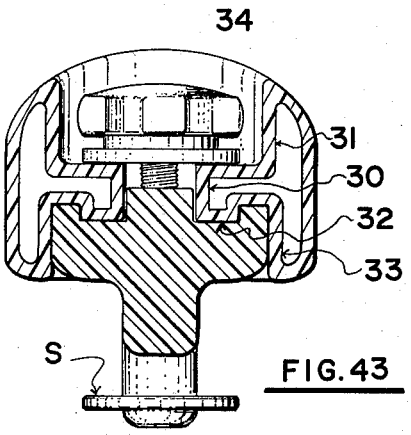
FIG. 43 is an enlarged cross section along the line 5—5 of FIG. 39 showing the track and the righthand restraint and end post detail.
Figure 46:
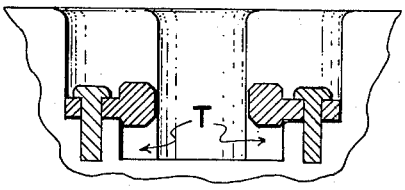
FIG. 46 is a cross sectional view along the line 46—46 of FIG. 45, of the recess connector point showing track detail. Note that it is recessed to accommodate wide post swing above track and recess "T" to engage flange on "S" (FIG. 43). Also note track detail to allow post to swivel clear of attachment screws.
Figure 44:
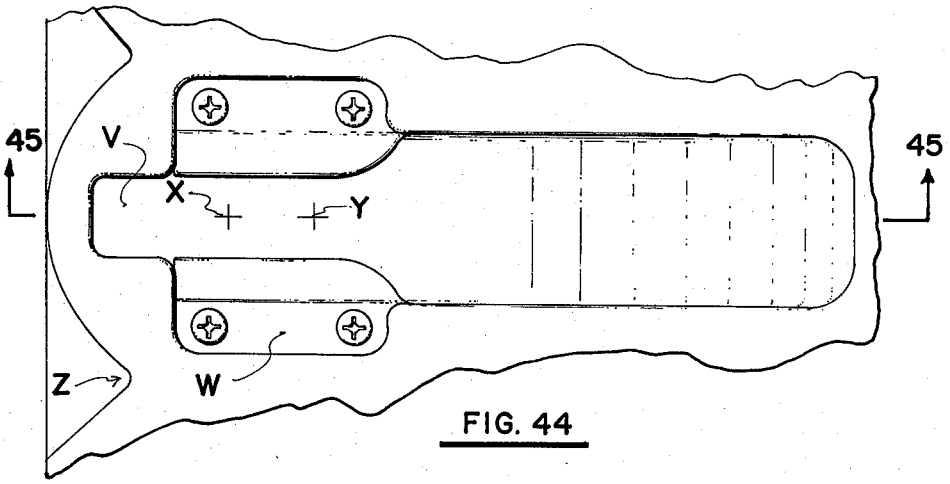
FIG. 44 is an enlarged plan view of the recess connector point showing track "W", fixed point post center "X", slidable post center "Y", slide release slot for post "U", and post lock slot "V". "Z" is a stop and/or guide for adjustable restraint.
Figure 45:
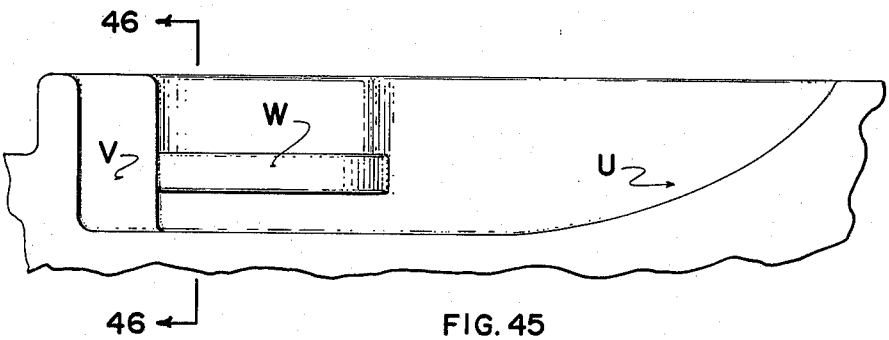
FIG. 45 is a longitudinal section along the line 45—45 of FIG. 44.
Figure 49:
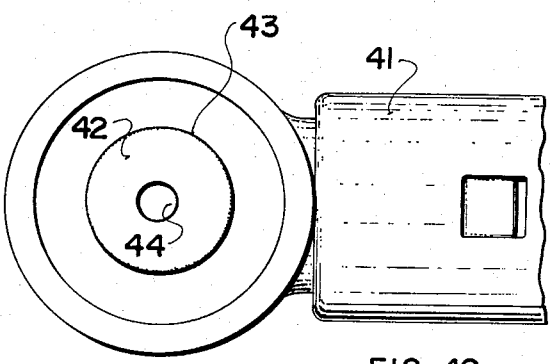
FIG. 49 is a plan view of FIG. 47 but in the fixed mode.
Figure 47:
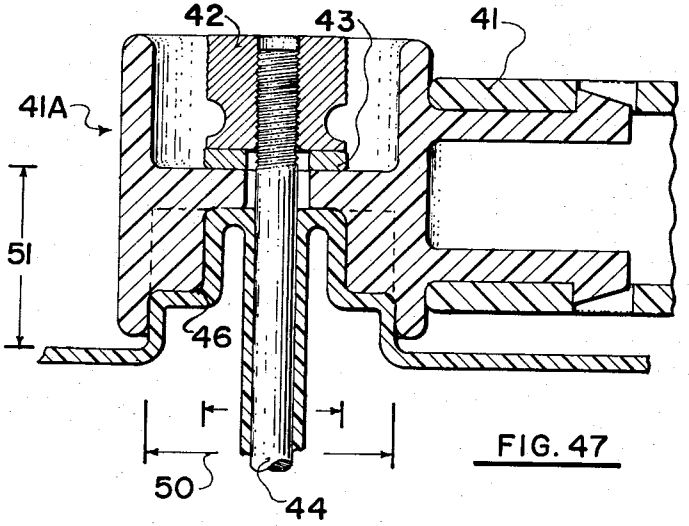
FIG. 47 is a fragmentary cross sectional view of the preferred connection of the connector.

Given a preference for fixing the principal connector to one of the skis, with the need for this connector to be capable of both a fixed and slideable mounting to said ski, the connector detail shown in FIGS. 21, 22 and 23, and lefthand side of FIGS. 13, 14 and 15 becomes preferable with section FIG. 19 that is obviously a compatible modification of the section in FIG. 26. Here a flush mount on the disconnect ski may be realized simultaneously with the above full mounted post condition. See FIGS. 39 to 43 for this combination variation.

Improvement in other water ski hardware is shown in the foot restraint side holding plate detail whereby improvement is made over conventional flat sections by provision of a curved or rounded surface at the inside bearing surface of the plate where it meets the foot restraint "strap", this curved surface may be smooth or textured to increase the friction between it and the foot restraint so as to improve the bearing surface character between the plate and the restraint. By reducing the discontinuity between the stress pick-up point between the plate and the restraint an improved service life for the restraint is realized, similarly maximizing surface contact, and minimizing point loading at the screws by maximizing plate/restraint friction increases the benefit where restraint material is suitable.

Figure 52:
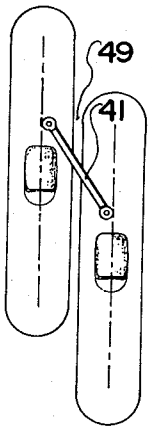
FIG. 52 is a schematic plan view of a pair of skis shown in echelon relationship.
Figure 51:
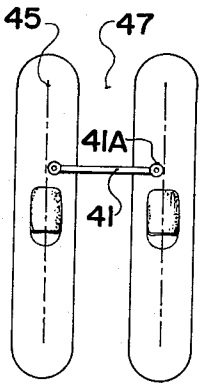
FIG. 51 is a schematic plan view of a pair of skis set in the wide configuration.
Figure 50:
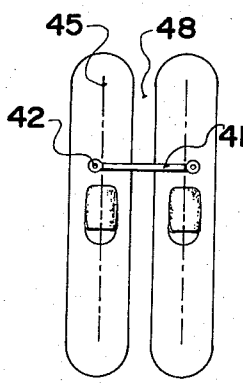
FIG. 50 is a schematic plan view of a pair of skis set in the narrow configuration.
Figure 48:
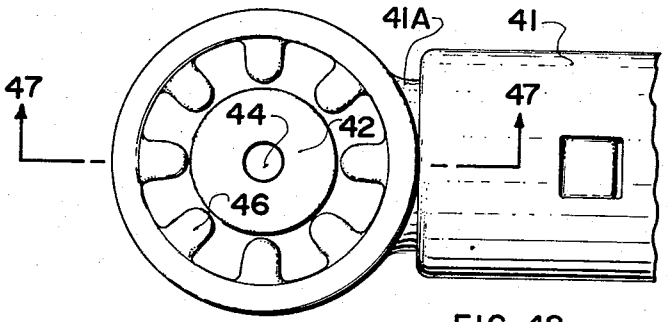
FIG. 48 is a plan view of FIG. 47 in the fore and aft moving mode.

The preferred embodiment is illustrated in FIGS. 47 to 52 inclusive and included in the species of connectors above mentioned is a simple tube 41, of ABS plastic or other material with elasticity or "memory" so as to allow torsion spring action, fitted with ends moulded so as to engage the ski hulls. Knurled nuts 42 and accompanying friction reducing nylon washers 43 are well suited to fix such device via a threaded shaft 44 embedded in the hull, to said hull. Further where the attachment point on the hull is located to one side of the longitudinal axis 45 of the hull (as shown in FIGS. 50 and 51) then this simple tube may realize a variety of configurations (as shown in FIGS. 50, 51 and 52). Where the hull connector point is splined as at 46 or otherwise deviates from a round section, then the connector tube ends 41A may be suitabley mated so as to be capable of relatively rigid mounting (as shown in FIGS. 47, 48, 50 and 51). With mounting points on hulls placed inboard (FIG. 51) the skis can be fixed in a broad beam (47), outboard. With the ski hulls switched, (FIG. 50) the beam of the connected pair is more narrowly fixed (48). This variation is desirable so as to accommodate different levels of skier skills. Further, the skis may be moved even further together (49) by staggering one ahead of the other before fixing the connector in place (FIG. 52).

Where the connector at the tube end lacks splines or deformation from the round, on one side, then both variations in beam and waterline can be sustained by turning over the connector tube 41 (FIG. 48, splines up). In this case some rigidity in the horizontal plane is eliminated. While a splined hub extending from the ski hull is here shown (FIG. 47. Hub diameter 50, height 51, is splined or indented to diameter 52.) it is obvious that a variety of alternate configurations is possible; the hub could be indented for example.

Reference to this connector is made because of its relative simplicity, it being but one preferred embodiment of the species of connectors above referred to previously.

Given the above it is obvious that a single tube 41 fitted with ends 41A suitably moulded, splined on one side (FIG. 48), smooth on the other (FIG. 49), could readily and simply realize a broad range of useful configurations.

Since various modifications can be made in my invention as hereinabove described, and many apparent widely different embodiments of same made within the spirit and scope of the claims without departing from such spirit and scope, it is intended that all matter contained in the accompanying specification shall be interpreted as illustrative only and not in a limiting sense.

What I claim as my invention:

1. A pair of buoyant water ski components or the like and means incorporated thereto connect said components in spaced and parallel relationship with one another to form a platform, and foot engaging means on the upper surface of each of said components, said connecting means including a connector member and means detachably securing said connector member by one end thereof to one of said skis and by the other end thereof to the other of said skis intermediate the ends of said skis, and approximately midway along the length of said skis, said connector member being in the form of a torsion bar whereby said skis are each movable independently in a fore and aft vertical pitching movement, within limits, around the axis of said connector member, due to the torsional characteristics of said connector, the connector means at the ends of said connector member including further means for maintaining the parallelism of said skis and facilitating horizontal plane rigidity of said skis.

2. The device according to claim 1 in which said connector member is adjustably secured to said skis whereby said skis can be fixed in a fore and aft direction relative to one another.

3. The device according to claim 2 in which said connector bar is secured to said skis on one side of the longitudinal axis of said skis whereby said skis can be secured to said connector bar in a relatively close parallel relationship when said skis are positioned whereby the connections of said bar to said skis is on the inner side of said longitudinal axis and can be secured to said connector bar in a relatively wide parallel position when said skis are positioned whereby the connections of said bar to said skis is on the outer side of said longitudinal axis.

4. The device according to claim 1 in which said connector bar is secured to said skis on one side of the longitudinal axis of said skis whereby said skis can be secured to said connector bar in a relatively close parallel relationship when said skis are positioned whereby the connections of said bar to said skis is on the inner side of said longitudinal axis and can be secured to said connector bar in a relatively wide parallel position when said skis are positioned whereby the connections of said bar to said skis is on the outer side of said longitudinal axis.

5. The device according to claims 1, 2 or 4 in which said means to detachably secure said connector member to said skis include a detachable vertically situated splined connection between said connector bar and said skis, said splined connections being lockably secured in any one of a plurality of positions whereby said skis are in fixed symmetrical side by side relationship or in fixed echelon relationship as desired so as to realize a substantially rigid platform with no substantial roll for individual skis but with controlled and limited pitching movement for said skis.

6. The device according to claim 3 in which said means to detachably secure said connector member to said skis include a detachable vertically situated splined connection between said connector bar and said skis, said splined connections being lockably secured in any one of a plurality of positions whereby said skis are in fixed symmetrical side by side relationship or in fixed echelon relationship as desired so as to realize a substantially rigid platform with no substantial roll for individual skis but with controlled and limited pitching movement for said skis.

* * * * *